US005640717A

United States Patent [19]

Ray

[11] Patent Number: 5,640,717

[45] Date of Patent: Jun. 24, 1997

[54] COMFORTING CLOTHING FOR NEWBORNS

[76] Inventor: Christina Ray, 29 Lombardy Lane, Leamington, Ontario, Canada, N8H4A2

[21] Appl. No.: 528,431

[22] Filed: Sep. 14, 1995

Related U.S. Application Data

[63] Continuation-in-part of Ser. No. 179,194, Jan. 10, 1994, abandoned, which is a continuation-in-part of Ser. No. 950,330, Sep. 24, 1992, abandoned.

[51] Int. Cl.[6] ..... A41D 11/00; A41D 10/00

[52] U.S. Cl. ..... 2/69; 2/69.5; 2/75; 2/80; 2/83; 2/912; 2/913

[58] Field of Search ..... 2/46, 48, 49.1, 2/49.2, 49.3, 49.4, 49.5, 50, 51, 52, 80, 75, 83, 69, 69.5, 104, 105, 106, 113, 114, 115, 88, 912, 913, 914, 915

[56] References Cited

U.S. PATENT DOCUMENTS

| | | | |
|---|---|---|---|
| 3,098,236 | 7/1963 | Bernfeld | 2/106 |
| 3,739,399 | 6/1973 | Sheahon | 2/69.5 OR |
| 4,117,840 | 10/1978 | Rasure | 2/69 X |
| 4,253,197 | 3/1981 | Posta | 2/80 X |
| 4,616,365 | 10/1986 | Lyons | 2/69 |
| 4,759,082 | 7/1988 | Mulligan | 2/69.5 |
| 4,897,885 | 2/1990 | Lunt | 2/69.5 |
| 5,005,217 | 4/1991 | Bern et al. | 2/104 |
| 5,274,842 | 12/1993 | Hogan | 2/105 X |

*Primary Examiner*—Jeanette E. Chapman

[57] ABSTRACT

This invention relates to clothing that comforts newborns in periods of stress. The clothing holds arms of the newborn close to its body and is easily put on and taken off. The clothing comprises first and second sections fitting on the newborn's torso, side sections fitting over newborns' shoulders and integrating the first and second sections together and wraps extending from the second section. The wraps extend to the first section where they fasten in holding the newborns arms and hands close to its body beneath the first section. The first section, tightly held to the newborns body by the wraps, holds the arms and hands at the chest and abdomen area. The clothing may be worn either with the first section extending from the collar over the front of the newborn or over the back of the newborn.

20 Claims, 1 Drawing Sheet

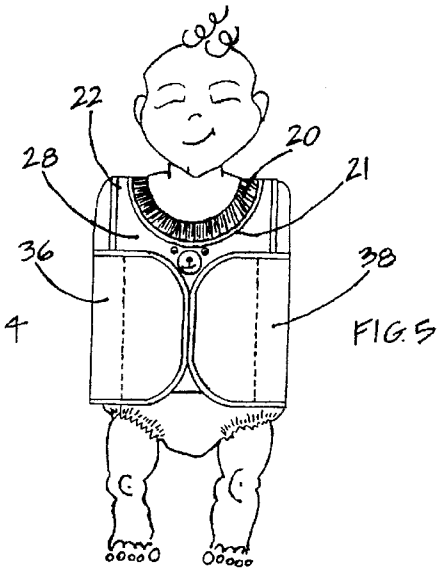
FIG. 4
FIG. 5
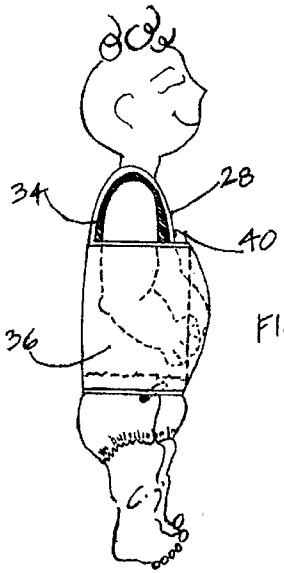
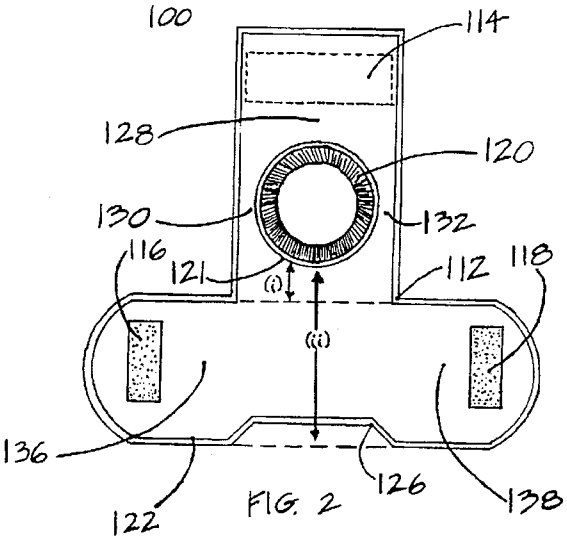
FIG. 2
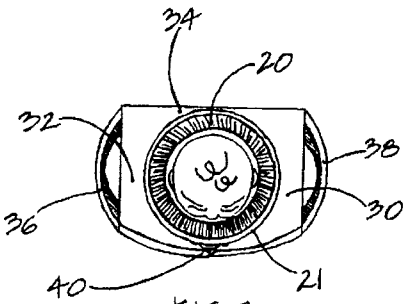
FIG. 3
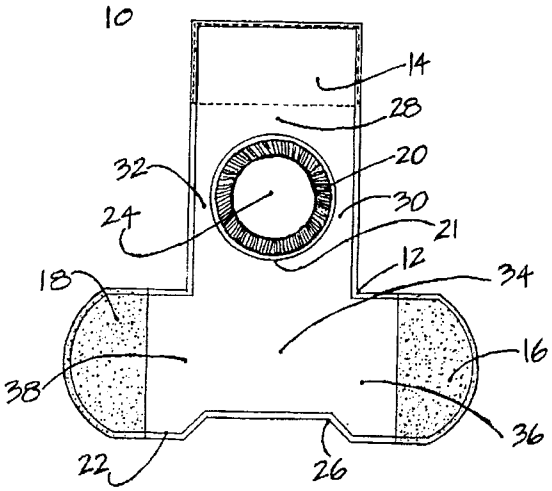
FIG. 1

COMFORTING CLOTHING FOR NEWBORNS

This application is a continuation in part (CIP) of U.S. Ser. No. 08/179,194 filed Jan. 10, 1994, now abandoned, which, in turn, is a continuation (CIP) in part of U.S. Ser. No. 07/950,330 filed Sep. 24, 1992, now abandoned.

BACKGROUND OF THE INVENTION

This invention relates to clothing useful in care of babies, especially newborn babies up to about four months old whose developing nervous systems exhibit a "startle" or "Moro" reflex. The readily applied clothing is useful in comforting these newborns during periods of temporary stress thereby aiding in their care and development and in handling the newborns during these periods.

Babies exhibit a large number of innate reflexes during their development including, for example, blinking, sneezing, sucking, rooting, and crawling reflexes. The Moro or startle reflex, manifested by extension and abduction of the newborn's arms while lying on its back, as well as by distinctive finger movements, is still another reflex newborns possess. It can precipitate when the newborn experiences sudden movements or noises and culminates in the newborn crying in apparent discomfort.

Holding newborns and eliminating frightening noises end experiences reduces consequences of the Moro or startle reflex. Moreover, wrapping the newborn firmly in a soft blanket comforts the newborn and prevents movement of the arms including movements characteristic to the startle reflex. However, there are times when even the above practices are unsuited or inconvenient in preventing or mitigating the effects of the startle reflex, e.g., late night feedings, diaper changes, dispensing medications, etc. Moreover, surgical and medical procedures such as vaccination and circumcision may be more easily accomplished with less stress on the infants if the arms of the infant could be held firmly close to its body.

U.S. Pat. No. 3,739,399 to Sheahon discloses neonatal clothing for use in establishing thermoregulatory stability of just delivered newborns. The neonatal clothing of Sheahon's to U.S. Pat. No. '399 differs in purpose and construction from this invention. Sheahon's clothing is designed for temperature control and is constructed with a series of wraps extending around the newborn's body, including four wraps used in holding arms of the newborn and other wraps. The neonatal clothing of Sheahon has a collar that is closed in putting on the clothing.

to U.S. Pat. No. 4,117,840 to Rasure discloses a restraint jacket for use in securing the pediatric wearer to a bed, lounge chair, chair, or other body supporting structure. The wraps of Rasure's restraint jacket in to U.S. Pat. No. '840 are shown as creating arm holes through which arms of the wearer extend. In sharp contrast, the comforting clothing of this invention holds a newborn's arm's close to its body in the area of its chest and abdomen. Moreover, the restraint jacket for pediatric use disclosed by Rasure '840 is of different character and there is no disclosure suggesting sizing for newborns. Upper and lower portions of the back section of Rasure's restraint jacket are about equal in width, not widely disportionate in width as in the comforting clothing for newborns of this invention.

Other patents of possible interest are to U.S. Pat. No. 5,274,484 to Hogan; to U.S. Pat. No. 5,005,217 to Bern et. al.; to U.S. Pat. No. 4,897,885 to Lunt; to U.S. Pat. No. 4,759,082 to Mulligan; to U.S. Pat. No. 4,616,365 to Lyons; to U.S. Pat. No. 4,253,197 to Posta; U.S. 3,098,236 to Bernfield.

BRIEF DESCRIPTION OF THE INVENTION

This invention relates to comforting clothing for a newborn which, when worn by the newborn, holds the newborn's arms and hands in the area of its chest and abdomen. The clothing comprises (a) a first section extending a first distance from a collar of the clothing when the clothing is being worn by the newborn; (b) a second section having upper and lower portions, the lower portion being more remote from the collar than the upper portion when the clothing is being worn by the newborn, having a width that is substantially greater than a width of the upper portion and extending a second distance, about equal the first distance, from the collar when the clothing is being worn by the newborn; (c) first and second side sections respectively extending between the first and second sections over a shoulder, the first side section, the first section, the second side section and the upper portion forming said collar; (d) wraps holding arms of the newborn close to its body and fastenable to said first section, the wraps consisting of first and second wraps respectively extending lengthwise from the lower portion over an arm of the newborn to the first section when the clothing is being worn by the newborn. These wraps respectively having (i) widths that are at least about as wide as the distance the first section extends below the collar when the clothing is being worn by the newborn and (ii) lengths that preferably extend to adjacent locations of the first section when the clothing is being worn by the newborn; first contact fastening means carried by the first section on a first surface of the clothing that is away from the newborn when the clothing is being worn by the newborn; (f) second contact fastening means carried by the first wrap on a second surface of the clothing opposite the first surface; (g) third contact fastening means carried by the second wrap on the second surface.

The first, second and third contact fastening means, respectively, preferably are made comprising material that is Velcro™ fastening means. The width of said first wrap preferably substantially equals a width of said second wrap. The first wrap preferably has a width that substantially equals a distance the lower portion extends below the upper portion. The clothing preferably has a marker on the front section adjacent the collar. The second section preferably has a cut out in the lower portion that is opposite the upper portion.

The clothing preferably is worn by the newborn such that the first section is on the front of the infant and the second section worn on the back of the newborn but the first section may be worn on the back of the newborn and the second section worn on the front and still achieve benefits of this invention.

The clothing serves in comforting newborns through holding their arms close to their body next to their chest and abdomen. The comforting clothing is useful in helping to keep a newborn calm thereby aiding the care giver during activities such as changing diapers, dispensing medicines and other such times when the experience may frighten newborns and induce their startle or Moro reflex.

This invention also relates to a method of comforting newborns comprising dressing them in the comforting clothing in a manner that holds their arms close to their body on their chest and abdomen area.

BRIEF DESCRIPTION OF THE DRAWINGS

FIGS. 1 and 2 show comforting clothing 10 and 100 of this invention.

FIGS. 3, 4 and 5 are developed top, side and front views, respectively, of the comforting clothing 10 of this invention, each taken as the clothing 10 is being worn by a newborn.

DETAILED DESCRIPTION OF PREFERRED EMBODIMENTS

FIG. 1 shows comforting clothing 10 made from material comprising cloth 12. Clothing 10 can be viewed as having front section 28, back section 34 and left and right side sections 30,32. Left and right side sections 30,32 respectively extend between front section 28 and back section 34 on either side of opening 24. Left and right wraps 36,38 extend from lower portion 35 of back section 34 around sides of the newborn when clothing 10 is worn as depicted in FIGS. 3–5.

The width of lower portion 35 of back section 34 (i.e., distance lower portion 35 extends from collar 21 less distance upper portion 37 extends from collar 21) is much greater, e.g., at least about three times the width of upper portion 37 of back section 34 (i.e., distance upper portion 37 extends from collar 21). This geometry enables wraps 36,38, which extend from lower portion 35, to extend around upper portions of the newborn's body in holding its arms close to the body when fastened to front section 28.

Clothing 10 also has integral VELCRO™ closure segments 14, 16 and 18. Velcro™ closure segments 14, 16 and 18 or other contact fasteners are sewn onto cloth 10 but may be otherwise affixed to cloth 12 by any convenient means, e.g., bonding by adhesive or sewn into cloth 12. Closure segments 14,16 face outward on a surface of clothing 10 opposite segment 18 so that they can be made to mate with closure segment 18 when the newborn is dressed in clothing 10 as shown in FIGS. 3–5.

Cloth 12 is made using sheets of cotton flannel but any material compatible in the care of newborns, e.g., vinyl coated nylon, gingham, spandex can be used. Cloth 12 has stitches 22 around its periphery. Stitches 22 stitch cloth 12 together a like shaped cloth material (not shown) forming the opposite surface (not shown) of clothing 10. Batting (not shown) is stitched between cloth 12 and the like shaped cloth material.

In putting clothing 10 on a newborn's body, the newborn's head is passed through opening 24. Collar ribbing 20, elasticized material extending inwardly around collar 21, is continuous, i.e., unbroken, and is deformable in easing passage of the newborn's head through opening 24. Back section 34 is then positioned over the newborn's back and front section 28 positioned over its arms and hands which are or have been brought onto the chest and abdomen area of the newborn. (Notch 26, a cut out of lower portion 35 of back section 34, provides clearance for adding or removing the newborn's diaper.)

Right and left wraps 36,38, respectively carrying at their remote ends VELCRO™ closure segments 16,18, then are brought around to front section 28. Fastening closure segments 16,18 to closure segment 14 then holds arms of the newborn beneath front section 28. Ornament 40 aids in identifying a desirable location for positioning wraps 36,38 extend when bringing them around the newborn's arms to the front of its body.

Clothing 100 of FIG. 2 differs from that of FIG. 1 in the size and shape of the VELCRO™ closure segments 114, 116 and 118. VELCRO™ closure segment 114 is 2 inches by 8 inches (5.08×20.32 centimeters) and segments 116,118 are each 2 inches by 4 inches (5.08×16.16 centimeters).

Other dimensions of clothing 100 are: (a) distance from tip of wrap 136 to tip of wrap 138 is 21.5 inches (54.9 cm); (b) width of wrap 136 is 7 inches (17.8 cm); (c) diameter of collar 121 is 5.5 inches (14 cm); (d) width of front section 128 is 8 inches (20.3 cm); (e) distance from collar 121 to end of front section 128 is (7) inches (17.8 cm); (f) distance from collar 121 to a line separating lower portion 135 and upper portion 137 of back section 134 (distance (i) in FIG. (2)) is 1.5 inches (3.8 cm); (g) distance from collar 121 to line defining cutout 126 (distance (ii) of FIG. 2) is 8.5 inches (21.6 cm); and (h) width of side section 132 is 1.25 inches (3.2 cm). Clothing 100 is suited for average size young newborns and clothing 10, although having similar dimensions, is adjustable to the size of the newborn to a greater degree than clothing 100. Comforting clothing with other dimensions is also useful, particularly for larger or smaller than average size newborns and for older newborns.

Still another embodiment, not shown, duplicates the right half of the embodiment of FIG. 1, but also has fastening means on the outside of the right wrap for fastening to the left wrap which is long enough to extend over onto the right wrap and fasten to it.

Making clothing 10 or clothing 100 is readily achievable using materials and techniques widely known to those in the art. Generalized steps in making the clothing 100 and adaptations thereof are: (1) using pattern, cut out batting and material (which besides flannel may be nylon, vinyl or other cloth that may be readily sanitized) of clothing 100; (2) sew seams with thread per standard seam method to provide stitches 22; (3) cut two and three inch (5.08 cm, 7.62 cm) VELCRO™ strips to length and sew them to cloth 12 as VELCRO™ closure segments 16 and 18 and 14, respectively; cut and sew neckline of collar ribbing 20; and (4) cut out, sew together and mount ornamental marker 40 to front section 28.

FIGS. 3, 4 and 5 illustrate a newborn dressed in comforting clothing 10. Once the newborn's head is through opening 24 and front and back sections 28,34 in place, wraps 36,38 are brought over the newborn's arms and around to front section 28. Segments 16, 18 are brought into contact with segment 14 thereby fastening wraps 36,38 to front section 28. As a result, the newborn's arms are then held beneath wraps 36,38 and close to its body whether the elbows bend fully, partially (FIG. 4) or not at all.

Wraps 36,38 ordinarily extend to a middle part of front section 28 such that the ends of wraps 36,38 meet about midway, identified by marker 40, between the right and left edges of front section 28. As the newborns grow and their trunk and arms become larger, or, alternatively, with larger size newborns, wraps 36,38 are positioned similarly, although, depending on the placement of VELCRO™ segments 16,18 or other fastener on wraps 36,38 and front section 28, the ends of these wraps 36,38 may not meet as closely in the middle part of front section 28 as FIG. 5 depicts.

The comforting clothing can be worn otherwise than above described. The section denominated as front section 28, for example, may be on the newborn's back with the section denominated as back section 34 on the newborn's chest. In this circumstance, wraps 36,38 still fasten to section 28 but it is back section 34 that contacts the newborn's hands and arms and holds them close to the body. Moreover, either of side sections 30,32 may be fastened at a midpoint using Velcro fastener which can be fastened and unfastened when putting on and taking off the comforting clothing.

As is apparent, comforting clothing of this invention can be modified in a number of ways other than as described in the foregoing and still be within the scope of the appended claims.

What is claimed is:

1. Comforting clothing for a newborn which when worn by said newborn holds arms and hands of said newborn close to its body on the chest and abdomen, said clothing comprising:

(a) a first section extending a first distance from a collar of said clothing that extends around the neck of said newborn when said clothing is being worn by said newborn;

(b) a second section having upper and lower portions, said lower portion being more remote from said collar than said upper portion when said clothing is being worn by said newborn, having a width at least about three times a width of said upper portion and extending a second distance, about equal said first distance, from said collar when said clothing is being worn by said newborn;

(c) first and second side sections respectively extending between said first and second sections over a shoulder of said newborn, said first side section, said first section, said second side section and said upper portion forming said collar;

(d) wraps holding said arms close to the body of said newborn, said wraps consisting of first and second wraps respectively extending lengthwise from said lower portion over an arm of said newborn to said first section when said clothing is being worn by said newborn, said wraps respectively having (i) widths that are at least about as wide as a distance said first section extends from said collar when said clothing is being worn by said newborn and (ii) lengths that extend to locations of said first section when said clothing is being worn by said newborn;

(e) first contact fastening means carried by said first section on a first surface of said clothing that is away from said newborn when said clothing is being worn by said newborn;

(f) second contact fastening means carried by said first wrap on a second surface of said clothing opposite said first surface;

(g) third contact fastening means carried by said second wrap on said second surface.

2. The clothing in accordance with claim 1, wherein said first, second and third contact fastening means respectively are made comprising material that is Velcro™ fastening means.

3. The clothing in accordance with claim 2, wherein a width of said first wrap substantially equals a width of said second wrap.

4. the clothing in accordance with claim 3, wherein said first wrap has a width that substantially equals a distance said lower portion extends from said upper portion.

5. The clothing in accordance with claim 4, wherein said clothing has a marker on said front section adjacent said collar.

6. The clothing in accordance with claim 5, wherein said second section has a cut out that is opposite said upper portion.

7. The clothing in accordance with claim 3, wherein said first wrap has said Velcro™ fastening means close to its end.

8. A method of holding arms of a newborn close to its body in the chest and abdomen area, said method comprising:

(I) providing clothing comprising (a) a first section extending a first distance from an integral collar of said clothing around the neck of said newborn when said clothing is being worn by said newborn; (b) a second section having upper and lower portions, said lower portion being more remote from said collar than said upper portion when said clothing is being worn by said newborn, having a width at least about three times a width of said upper portion and extending a second distance, about equal said first distance, from said collar when said clothing is being worn by said newborn; (c) first and second side sections respectively extending between said first and second sections and over a shoulder of said newborn when said clothing is being worn by said newborn, said first side section, said first section, said second side section and said upper portion forming said integral collar; (d) wraps consisting essentially of first and second wraps respectively extending lengthwise from said lower portion over an arm of said newborn to said first section when said clothing is being worn by said newborn, said wraps respectively having (i) widths that are at least about as wide as the distance said first section extends below said collar when said clothing is being worn by said newborn and (ii) lengths that extend to adjacent locations of said first section when said clothing is being worn by said newborn; (e) first fastening means carried by said first section on a first surface of said clothing that is away from said newborn when said clothing is being worn by said newborn; (f) second fastening means carried by said first wrap on a second surface of said clothing opposite said first surface; and (g) third fastening means carried by said second wrap on said second surface, (II) putting the head of said newborn through said collar;

(III) adjusting said clothing, as necessary, so that said first section is over the front of said newborn atop arms thereof;

(IV) maintaining arms of said newborn beneath said first section; and (V) fastening said wraps and said first section together with said arms of said newborn beneath said first section.

9. The method in accordance with claim 8, which comprises bringing arms of said newborn to the area of the stomach and chest before bringing said wraps to said first section.

10. The method in accordance with claim 8, wherein said clothing comprises flexible ribbing extending inwardly around said collar, said ribbing deforming in passing the newborn's head through said collar.

11. Comforting clothing for a newborn which when worn by said newborn holds its hands and arms close to the body, said clothing comprising:

(a) a front section extending a first distance from a collar of said clothing extending around the neck of said newborn when said clothing is being worn by said newborn;

(b) a back section having upper and lower portions, said lower portion being more remote from said collar than said upper portion when said clothing is being worn by said newborn, having a width at least about three times greater than a width of said upper portion and extending a second distance, about equal said first distance, from said collar when said clothing is being worn by said newborn;

(c) first and second side sections respectively extending between said front and back sections over a shoulder of said newborn when said clothing is being worn by said newborn, said first side section, said front section, said second side section and said upper portion forming said collar;

(d) wraps holding said arms close to the body of said newborn, said wraps consisting of first and second wraps respectively extending lengthwise from said lower portion over an arm of said newborn to said front section when said clothing is being worn by said newborn, said wraps respectively having (i) widths that are at least about as wide as a distance said front section extends from said collar when said clothing is being worn by said newborn and (ii) lengths that extend to said front section when said clothing is being worn by said newborn;

(e) first contact fastening means carried by said front section on a first surface of said clothing that is away from said newborn when said clothing is being worn by said newborn;

(f) second contact fastening means carried by said first wrap on a second surface of said clothing opposite said first surface;

(g) third contact fastening means carried by said second wrap on said second surface.

12. The clothing in accordance with claim 11, wherein said first, second and third contact fastening means respectively are made comprising material that is Velcro™ fastening means.

13. The clothing in accordance with claim 12, wherein a width of said first wrap substantially equals a width of said second wrap.

14. The clothing in accordance with claim 11, wherein said first wrap has a width that substantially equals a distance said lower portion extends below said upper portion.

15. The clothing in accordance with claim 11, wherein said clothing has a marker on said front section adjacent said collar.

16. The clothing in accordance with claim 15, wherein said back section has a cut out that is opposite said upper portion.

17. The clothing in accordance with claim 13, wherein said first wrap has said Velcro™ fastening means close to its end.

18. The clothing in accordance with claim 11, wherein said lower portion has a dimension substantially greater than the greatest distance said upper portion extends from said collar.

19. The clothing in accordance with claim 11, wherein said collar has flexible ribbing, said ribbing extending inwardly around said collar continuously.

20. The clothing in accordance with claim 11, wherein said Velcro™ fastening means extends across a width of said right wrap.

* * * * *